US008910323B1

(12) United States Patent
Goettl

(10) Patent No.: US 8,910,323 B1
(45) **Date of Patent: *Dec. 16, 2014**

(54) SWIMMING POOL WATER LEVELER AND METHOD

(75) Inventor: John M. Goettl, Phoenix, AZ (US)

(73) Assignee: GSG Holdings, Inc., Chandler, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/597,145

(22) Filed: Aug. 28, 2012

Related U.S. Application Data

(62) Division of application No. 12/425,347, filed on Apr. 16, 2009, now Pat. No. 8,266,737.

(60) Provisional application No. 61/047,360, filed on Apr. 23, 2008.

(51) Int. Cl.
*E04H 4/00* (2006.01)
*E04H 4/12* (2006.01)

(52) U.S. Cl.
CPC ..... *E04H 4/12* (2013.01)
USPC ..... 4/508; 4/507; 137/462

(58) Field of Classification Search
USPC ..... 4/507–509, 504, 668, 669, 541.2; 137/462
See application file for complete search history.

(56) References Cited

U.S. PATENT DOCUMENTS

| | | | | |
|---|---|---|---|---|
| 1,323,960 | A | | 12/1919 | Burrill |
| 1,476,029 | A | | 12/1923 | Black |
| 2,013,188 | A | | 9/1935 | Reinhardt |
| 2,439,282 | A | | 4/1948 | Beckett |
| 2,940,467 | A | | 6/1960 | Smith |
| 3,877,482 | A | | 4/1975 | Rawdon |
| 3,895,645 | A | | 7/1975 | Johnson |
| 4,230,142 | A | | 10/1980 | Saarem et al. |
| 4,373,220 | A | | 2/1983 | Selsted |
| 4,431,024 | A | | 2/1984 | Gallagher |
| 4,600,031 | A | * | 7/1986 | Nestich ..... 137/218 |
| 4,607,399 | A | * | 8/1986 | Yovanofski ..... 4/508 |
| 5,154,205 | A | | 10/1992 | Langill |
| 5,255,703 | A | | 10/1993 | Johnson |
| 5,365,617 | A | * | 11/1994 | Tarr ..... 4/508 |
| 5,421,361 | A | | 6/1995 | Johnson |
| 5,439,025 | A | | 8/1995 | Johnson |
| 5,623,961 | A | | 4/1997 | Nichols-Roy |
| 5,655,232 | A | | 8/1997 | Buckwalter |
| 5,715,859 | A | | 2/1998 | Nichols-Roy |
| 5,790,991 | A | * | 8/1998 | Johnson ..... 4/508 |
| 6,260,574 | B1 | | 7/2001 | Nichols-Roy |
| 6,263,906 | B1 | * | 7/2001 | Wilson ..... 4/508 |
| 6,450,195 | B1 | | 9/2002 | Gil |
| 6,659,125 | B1 | | 12/2003 | Autunez |
| 2007/0186979 | A1 | * | 8/2007 | Thompson et al. ..... 137/236.1 |

* cited by examiner

*Primary Examiner* — Huyen Le
*Assistant Examiner* — Erin Deery
(74) *Attorney, Agent, or Firm* — Booth Udall Fuller, PLC

(57) ABSTRACT

A swimming pool water leveler system. Implementations may include a water leveler comprising one or more of the following aspects: separate fill and sensing chambers within the water leveler housing; logical water level adjustment features that provide a tactile indicator of water level change; a continuous balance line and overflow line; a water supply line seal valve with a cup seal; a reducer plug in an outlet between the sensing chamber and the balance line to assist in junk removal; and the ability to pressure test the balance line and overflow line at the same time.

19 Claims, 10 Drawing Sheets

SWIMMING POOL WATER LEVELER AND METHOD

CROSS REFERENCE TO RELATED APPLICATIONS

This is a Divisional of earlier U.S. application Ser. No. 12/425,347 to Goettl entitled "Swimming Pool Water Leveler," which was filed on Apr. 16, 2009, which claims the benefit of the filing date of U.S. Provisional Patent Application 61/047,360 to Goettl entitled "Swimming Pool Water Leveler," which was filed on Apr. 23, 2008, the disclosures of which are hereby incorporated herein by reference.

BACKGROUND

1. Technical Field

Aspects of this document relate to combination water leveling devices for use in swimming pools.

2. Background Art

Conventional swimming pool water leveling devices include very simple direct operated float valves, pilot operated float valves, and various forms of electronic sensor controlled electric valves. A secondary reservoir that is in fluid communication with the pool is normally located adjacent to the pool. The fluid level in the secondary reservoir is typically maintained equal to the pool level through an inter-connection pipe. As the water level in the pool changes, the level in the adjacent water reservoir changes to equalize to the pool. A fill valve is typically mounted in the secondary reservoir to sense the water level and add water as required to maintain the water at a preset level. In the case of electronic devices, the sensor may be located with-in or adjacent to the pool and the fill water is introduced directly into the pool at another location. It is common to adapt the secondary reservoir with an overflow pipe through which excess water in the pool, such as from a rain storm, can overflow and gravity drain from the pool.

Many conventional swimming pool water leveling devices experience rapid water level fluctuation in the secondary reservoir due to activity in the pool or the water supply valve opening. This causes rapid on/off action of the water supply valving mechanism. This results in objectionable water hammer in the water supply valve and rapid wear of the valve. In the case of electronic automatic leveling devices, complicated and expensive electronic controls are employed to minimize excessive opening/closing of the water supply valve. Direct operating float valves, similar to those used in evaporative coolers, are dependable and do not cause water hammer through the opening and closing of the valve. However, direct operating float valves are difficult to replace within the reservoir and are very difficult to adjust to the desired water level, often requiring a service professional to make several separate and costly calls to achieve a proper level setting. Additionally, because of the relatively long operating arm required for direct operating valves, the secondary reservoir is necessarily large enough to house the long operating arm. This is a disadvantage for pool owners concerned with the large, unsightly opening in the pool deck.

Pilot operated valves, similar to those used in toilet reservoir tanks, can be used in a smaller secondary reservoir and are, thus, less aesthetically objectionable. Because these valves are pilot operated, delicate diaphragms and very small fluid control orifices are used. However, the small orifices used in the pilot operated valves yield troublesome operation due to the swimming pool environment. Level adjustment in pilot operated valves is typically achieved by some sort of screw or slidable adjuster which is an improvement over the adjustability of the direct operating float valve types. Pilot valves generally experience water hammer and rapid wear of the valve as the valve cycles on and off. To overcome the water hammer condition, the input water source is often severely restricted by installing a small orifice in the supply source. This results in slower filling of the swimming pool.

Electronic water level controllers are very expensive compared with other mechanical devices, and generally involve very complicated installations. Pilot operated valves are usually employed in such systems along with an electronic sensor and control system.

In conventional swimming pool systems, the balance line cannot be pressure tested and the overflow line is generally not pressure tested because of the difficulty in blocking each of the separate sections of the lines and connecting the testing apparatus to each. However, if the various water lines are not pressure tested, they may have leaks which can cause swelling of the soil and in extreme cases breakage of the pool in concrete pools.

SUMMARY

Implementations of a swimming pool water leveler system may comprise many aspects and components. Implementations may include a water leveler comprising one or more of the following aspects: separate fill and sensing chambers within the water leveler housing; logical water level adjustment features that provide a tactile indicator of water level change; a continuous balance line and overflow line; a water supply line seal valve with a cup seal; a comparatively small fluid passage between the balance line and the sensing chamber to dampen and smooth rapid level changes in the pool; a reducer plug in an outlet between the sensing chamber and the balance line to assist in junk removal; and the ability to pressure test the balance line, overflow line and the water supply line individually or at the same time.

Although not all implementations require every aspect of every implementation, and many implementations may only use one or more of the beneficial features and aspects, a particular implementation comprises water leveler housing with first and valve chambers in fluid communication with a balance line of a swimming pool through respective first and second openings in the balance line. The water leveler further comprises a water supply line feeding into the valve chamber through a valve, and an adjustable water level float in the housing chamber that provides pressurized water to the valve chamber from the water supply line when the water level in the housing chamber falls below a predetermined level.

In particular implementations, the valve may comprise a pressure seal within a cap pressed against the spout of the water supply line so that when an actuator associated with the water level float actuates, the pressure seal's pressure against the spout is relieved to allow water to enter the valve chamber from the water supply line. The valve actuator may comprise a valve lever coupled to the cap through at least two pivotable links.

In particular implementations, the valve chamber may be surrounded by the housing chamber. In other particular implementations, the water supply may be surrounded by the valve chamber. In still other particular implementations, the water level float comprises a linearly adjustable annular ring with at least one inwardly extending guide, the ring surrounding a rotatable guide coupled to a manual adjuster, wherein manual rotation of the adjuster causes the rotatable guide to rotate and guide the water level float linearly along the rotatable guide. The rotatable guide may comprise a discontinuous external thread, sections of which are horizontally distributed on the rotatable guide and at least one raised indicator nub on the water level float, wherein periodic spacing between the raised indicator nubs on the rotatable guide corresponds to a predetermined vertical adjustment of the water level float.

In particular implementations, the housing chamber opening comprises a removable reducer plug surrounding the housing chamber opening that when removed enlarges the housing chamber opening. In other particular implementations, the balance line is directly coupled to and in fluid communication with an overflow line, and wherein the balance line and the overflow line are each in fluid communication with the valve chamber through the second opening in the balance line.

In particular implementations, a method of maintaining the water level in a swimming pool at a predetermined level comprises passively supplying water from a swimming pool to a water leveler housing through a balance line having a first diameter; sensing a water level of a swimming pool in a housing chamber of the water leveler housing, the housing chamber in fluid communication with the balance line through a housing chamber opening having a second diameter less than ½ the diameter of the first diameter; and actively supplying pressurized water from a water supply line to a valve chamber of the water leveler housing if the water level of the swimming pool is below the predetermined level. In particular implementations the second diameter is less than ¼ the diameter of the first diameter and in other particular implementations the second diameter is less than 1/16 the diameter of the first diameter. Sensing the water level may comprise floating a vertically adjustable water level float in the housing chamber coupled to a water supply line spout actuator that actuates a water supply line spout if the water level of the swimming pool falls below a predetermined threshold.

In particular implementations, a method of adjusting a water level in a swimming pool comprises sensing a water level of a swimming pool in a water leveler housing from water passively supplied to the water level housing through a balance line; maintaining the water level of the swimming pool by passively adding water from a water supply line to the water leveler housing through the balance line when the water level sensed is below a predetermined level; and adjusting a vertical height of a sensor sensing the water level by turning a manual adjuster within the water level housing to adjust the predetermined level by a known amount that is known based upon the rotation of the manual adjuster. Adjusting the vertical height of the sensor may comprise adjusting the vertical height of a water level float coupled to an actuator configured to relieve pressure on a water supply line spout when the water level sensed is below the predetermined level.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components or assembly procedures disclosed herein. Many additional components and assembly procedures known in the art consistent with the intended swimming pool water leveler and/or assembly procedures for a swimming pool water leveler will become apparent for use with particular implementations from this disclosure. Accordingly, for example, although particular implementations are disclosed, such implementations and implementing components may comprise any shape, size, style, type, model, version, measurement, concentration, material, quantity, and/or the like as is known in the art for such swimming pool water levelers and implementing components, consistent with the intended operation.

Figure 1:
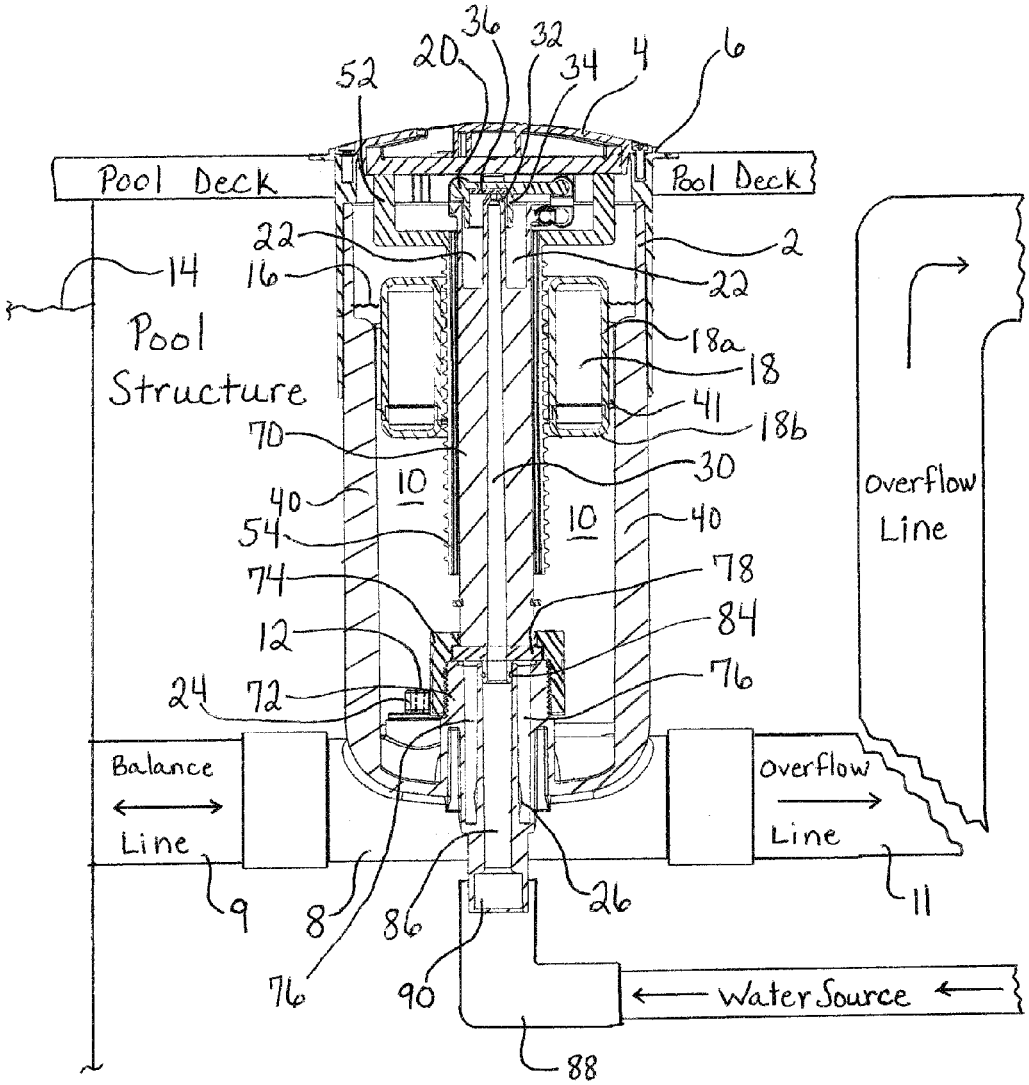
FIG. 1 is a system view of a swimming pool water leveler system.

With reference to FIG. 1, an implementation of a swimming pool water leveler is illustrated. The particular implementation illustrated comprises a water leveler housing 2 comprising a deck ring 6 and lid 4 mounted in a pool deck on a pool structure of a swimming pool. The water leveler housing 2 also comprises a passive water line 8 that extends through or along the water leveler housing 2 at a side of the water leveler housing 2 (see FIG. 4 for cross-sectional view rotated 90 degrees from FIG. 1). The water leveler housing 2 comprises a housing chamber 10 comprising a comparatively small housing chamber opening 12 into the passive water line 8. The housing chamber 10 is used as a sensing chamber to comparatively sense the swimming pool water level 14 by the housing chamber water level 16 balancing with the swimming pool water level 14 through the passive water line 8 and thru small housing chamber opening 12. The water in the housing chamber 10 is in fluid communication with the swimming pool water through the balance line 9 coupled to the swimming pool and the passive water line 8, and the first small housing chamber opening 12 in the passive water line 8 in communication with the housing chamber 10. Thus, as the swimming pool water level 14 rises or falls, the housing chamber water level 16 rises and falls comparatively. The small housing chamber opening 12 dampens fluctuations in the water level change in housing chamber 10 caused by rapid changes in the pool level 14 such as wave action caused by activity in the swimming pool. Thus, the rapid fluctuation of the valve and hammer effect experienced in many conventional leveler valves and the associated mechanical wear is controlled.

Float valve assembly 50 (see FIGS. 2, 3 and 5A and 5B) sits inside the housing chamber 10 and comprises a water level float 18 that floats in the water in the housing chamber 10 at or near the housing chamber water level 16. The water level float 18 may be formed of one or more float components depending on the method of manufacture. Float 18, in this particular implementation, is shown formed in two separate components 18*a* and 18*b* and coupled together. The water level float 18 is operatively coupled to the rotatable guide 54 of the valve assembly 50 and has a vertical operating range. The rotatable guide 54 is adapted to operate a water supply valve 20 of the valve assembly 50 open and closed. When the water level float 18 is raised high, the water supply valve 20 is closed. When the water level float 18 drops below a predetermined level, the water supply valve 20 is at least partially opened, allowing water to enter a valve chamber 22 of the valve assembly 50.

The small housing chamber opening 12 in the passive water line 8 is significantly smaller than the diameter of the balance line 9 and the comparably sized passive water line 8. Typically, a balance line 9 may have a diameter of one to two inches. In comparison, the small housing chamber opening 12 may have an opening less than about ½ to ¼ that size down to even about 1/16 that size, and in other implementations even smaller. In one particular non-limiting example, the small housing chamber opening 12 is one quarter inch in diameter and has a cross-sectional area of approximately 0.05 square inches. When used with a 1 inch pipe as the passive water line 8, the area ratio of the small housing chamber opening 12 to the passive water line 8 is 1/16. When used with a 1.5 inch passive water line 8 pipe, the small housing chamber opening 12 is 1/35 the area of the pipe. When used with a 2 inch passive water line 8 pipe, the small housing chamber opening 12 is 1/64 the area of the pipe. In particular implementations, the small housing chamber opening 12 is intentionally much smaller than the cross-sectional area of the passive water line 8 to reduce the effects of water flow in the passive water line that may be caused by excessive movement in the swimming pool or water being added through the leveler from through the water supply line 30 of the valve assembly 50. Although ratios larger than 1/16 may be used and are contemplated by this disclosure, it has been found that 1/2 and 1/4 ratio sizes are useful at reducing the effects of water flow and 1/16 ratio size and smaller is very effective.

If excessive water movement in the swimming pool, such as wave action from swimmer activity, is permitted to pass into the housing chamber 10 where the water level is sensed to control the valve, the water level float 18 will rise and fall with the water resulting in the valve 20 being undesirably opened and closed repeatedly in quick succession when there is no real net change in the swimming pool water level 14. The small housing chamber opening 12 allows the comparatively slow balance of water levels between the swimming pool and the housing chamber 10 without the negative effects of excessive water movement.

Although it is not required in all implementations, particular implementations of the small housing chamber opening 12 may comprise a removable reducer plug 24 with the small housing chamber opening 12 extending through it. When the removable reducer plug 24 is removed, the small housing chamber opening 12 between the housing chamber 10 and the passive water line 8 is significantly enlarged. This feature may allow for easy cleaning of the housing chamber 10 by allowing a maintenance worker to remove the reducer plug 24 and pass debris through the opening into the passive water line 8 and then replace the reducer plug 24 to restore normal operation. The reducer plug 24 may be provided with a different sized plug opening 24 to modify the diameter of the small housing chamber opening 12 and allow for a changing the flow rate from the balance line 9 to and from the housing chamber 10 in order to tailor to a particular installation.

The valve assembly 50 (FIG. 1) comprises a valve chamber 22 comprising a valve chamber opening 26 into the passive water line 8. The valve chamber 22 is used as a filling chamber through which additional water is added to the swimming pool to raise the swimming pool water level 14. A spout 32 of pressurized water supply line 30 is coupled to the water supply valve 20 and feeds water into the valve chamber 22 when the water supply valve 20 is open. Although any type of valve would work to provide water to the valve chamber 22 when the water level float falls below a predetermined level and other valve styles and types are contemplated for use in other implementations, the particular implementation illustrated in FIGS. 1-5B is a mechanically leveraged stop valve. The leveraged stop valve comprises a cap 34 holding a pressure seal 36 presses against the water supply line spout 32 when the valve is closed with sufficient force to keep the pressurized water from the water supply line 30 from escaping the spout 32 into the valve chamber 22. The cap 34 of the valve assembly 50 is coupled to an actuator 38 (FIG. 2) and to the valve chamber outer wall 66 (FIG. 3) through pivotable links 42, 44 and 46. The cap 34 comprises a recess to retain flexible valve seat 36 (FIG. 1). The cap 34 also serves as a deflector to direct upward water flow from the water supply line 30 to the valve chamber 22, which flows water to the passive water line 8 and not directly into the housing chamber 10 where the water level is sensed. The use of pivotable links 42, 44 and 46 in combination with the mechanical advantage of a valve lever 38 as an actuator coupled between the cap 34 and the valve chamber outer wall 66 allows the water leveler to maintain the valve closed with sufficient force to resist the water pressure in the water supply line 30 using very little force (only that caused by the water level float 18 rising the manual adjuster platform 62 against the valve lever 38).

Note that the only direct water communication between the housing chamber 10 and the valve chamber 22 in this implementation is through the housing chamber opening 12. Although some other communication between the chambers may be permissible, it is undesirable for the pressurized water from the spout 32 to directly affect the housing chamber 10 water other than through the small housing chamber opening 12. If a sufficient portion of the fill water from the leveler valve is directed into the housing chamber 10, as is the case with conventional devices of this type, the water level 16 in the housing chamber 10 rises faster than that of the pool and causes the valve to shut off prematurely. The housing chamber 10 then equalizes with the pool level and the valve comes on again, repeating until the pool water level 14 is high enough. This short cycling of the valve causes premature wearing of the valve and often causes objectionable water hammer in the supply line.

Figure 4:
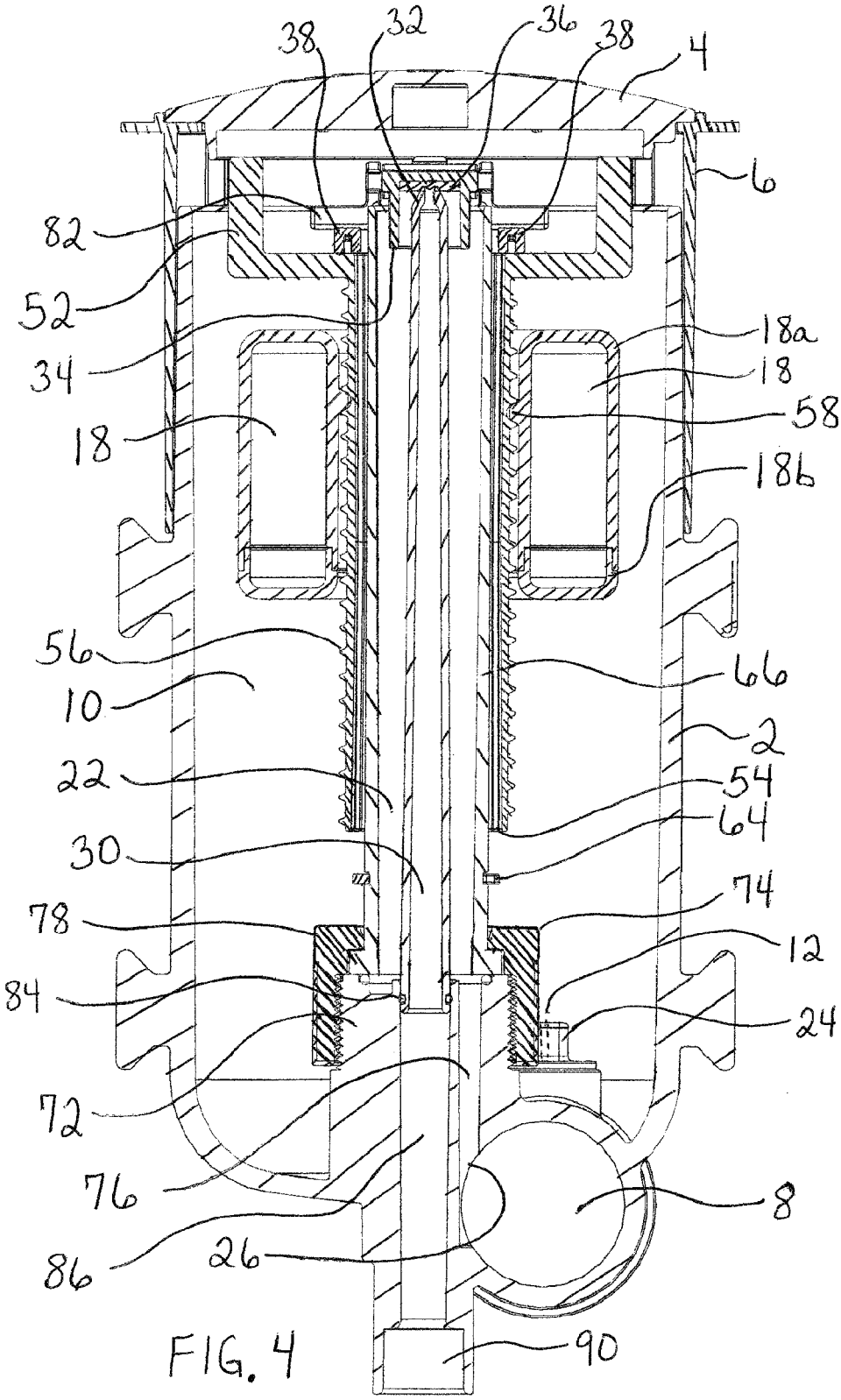
FIG. 4 is a sectional view of an adjustable water leveler housing and core taken at a view similar to that of section lines B-B of FIG. 2 if it included the housing.
Figures 5A, 5B:
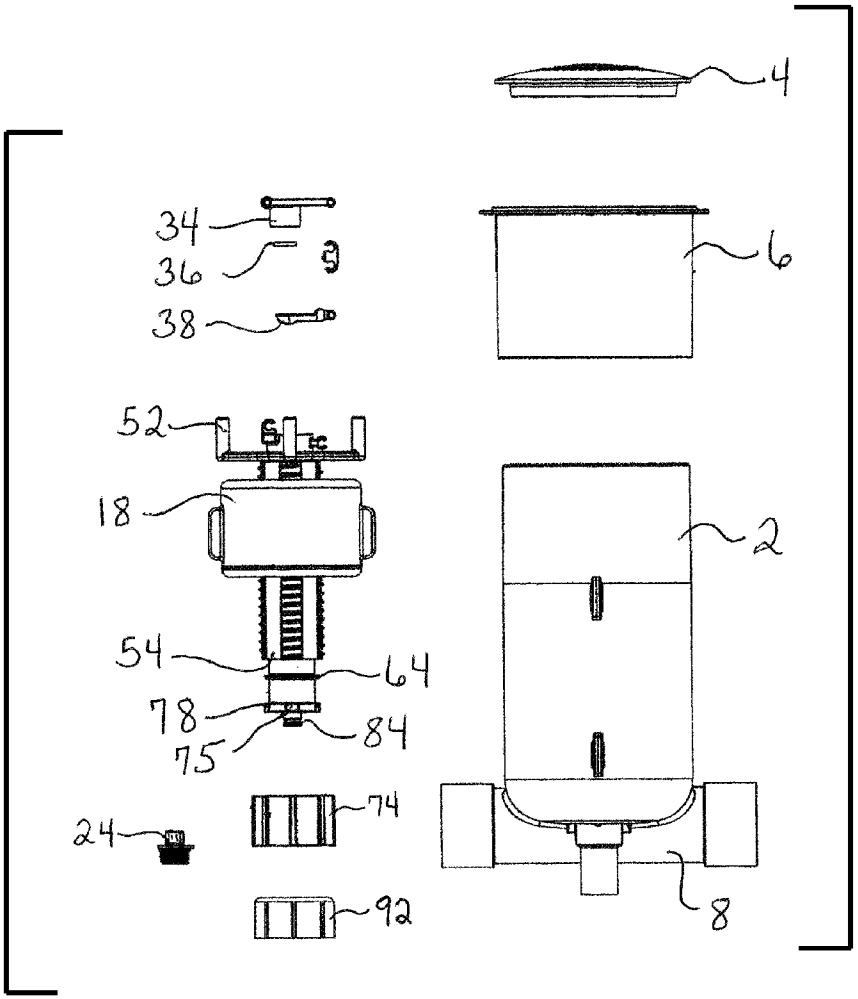
FIGS. 5A and 5B are exploded components illustrations of a swimming pool water leveler.
Figure 6:
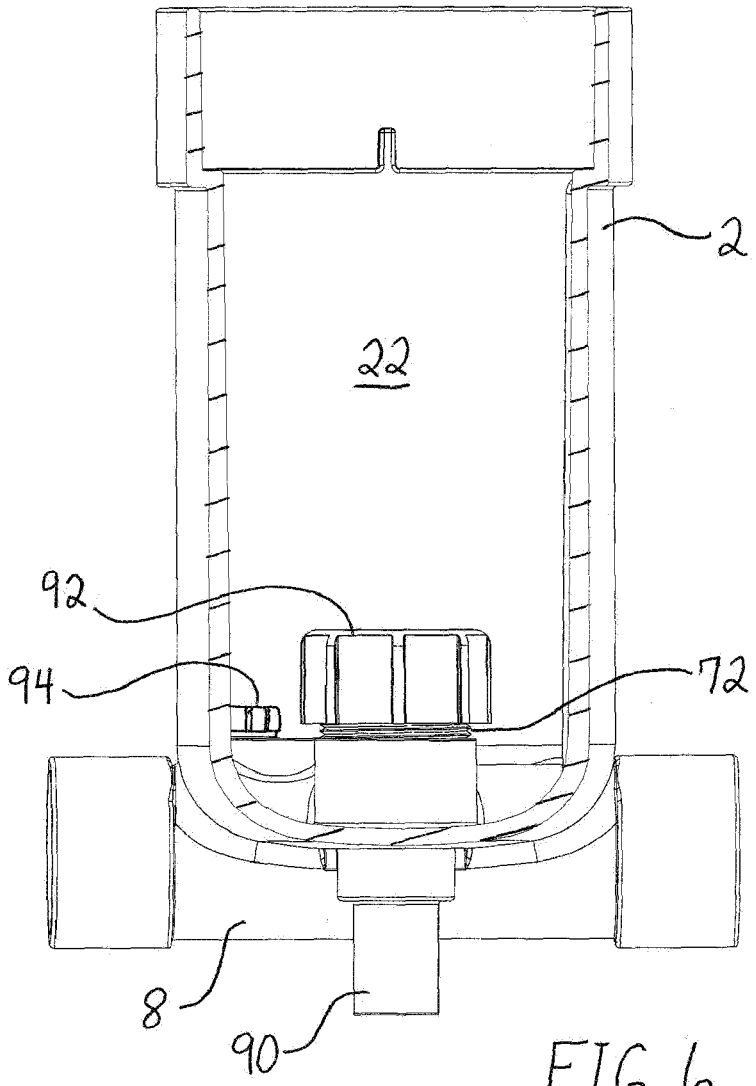
FIG. 6 is a front view of a swimming pool water leveler with the front portion of the housing removed to show optional pressure testing caps

One or more support ribs 70 are included within the float valve assembly 50 between the water supply line 30 and the outer wall 66 of the valve chamber 22 for support and ease of manufacture. As best illustrated by FIG. 4, in the particular implementation shown in FIG. 4, the water supply line 30 is surrounded by the valve chamber 22 which is surrounded by the housing chamber 10 (FIG. 1). This arrangement is particularly compact and efficient, but is not required for all implementations. One reason this compactness is important is that the housing chamber 10 and the valve assembly 50 are generally mounted in the pool deck adjacent a swimming pool and it is desirable to keep the visual intrusion as minimal as possible. Many conventional floats for float valves require relatively large housing because the float arms extend away from the valve.

As illustrated in FIG. 1, a float guide 40 extends vertically along the inner wall of the water level housing 2 and slidably engages with water level float fins 41 (see also FIG. 2) of the float valve assembly 50. The water level float 18 is slidably engaged with the water level housing 2. The coupling of the water level float fins 41 with the float guide 40 on the inner wall of the water level housing 2 keeps the water level float 18 relatively rotationally stationary as the float valve assembly 50 is adjusted to move the water level float 18 vertically.

Figure 2:
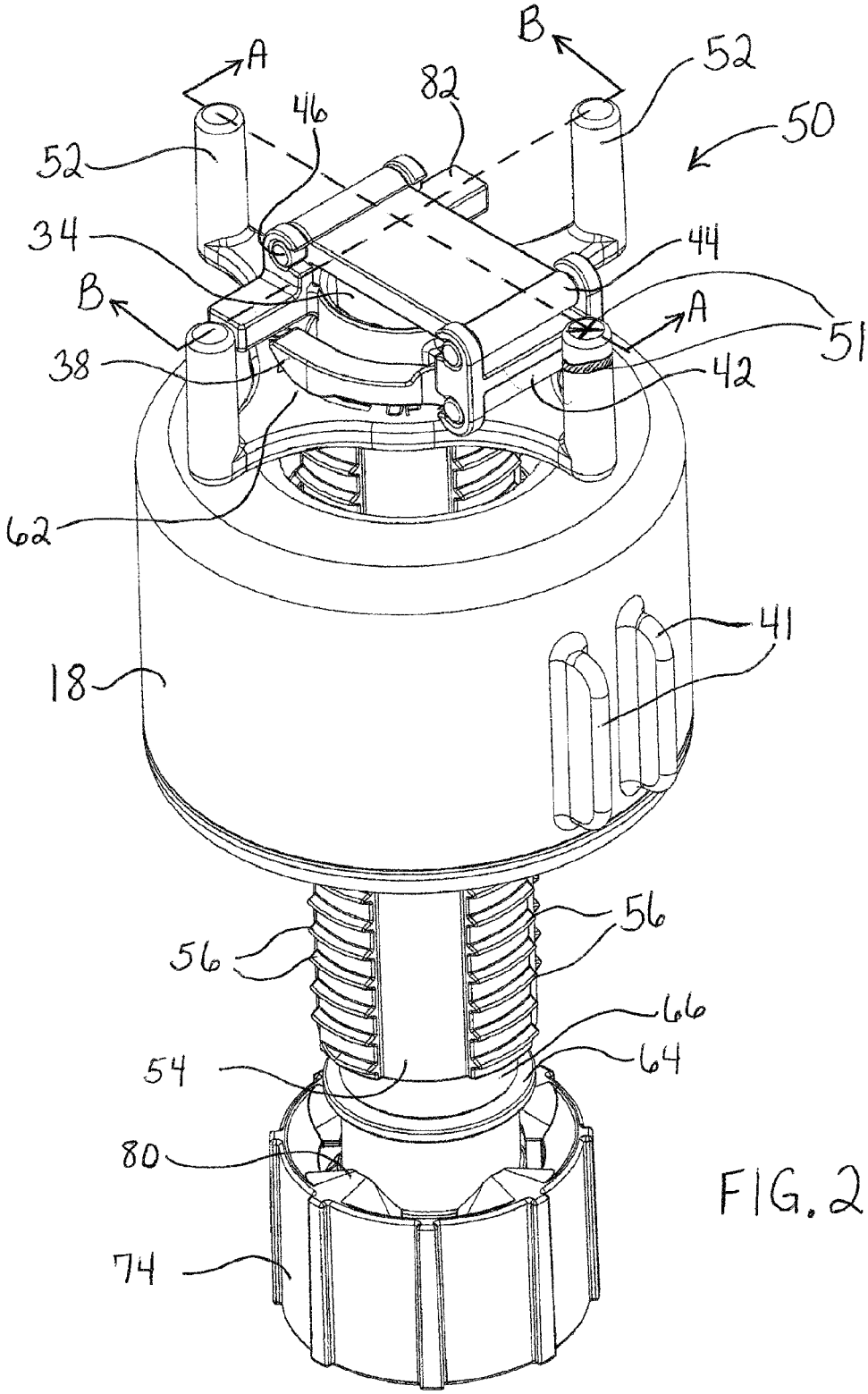
FIG. 2 is a perspective view of an adjustable water leveler core.
Figure 3:
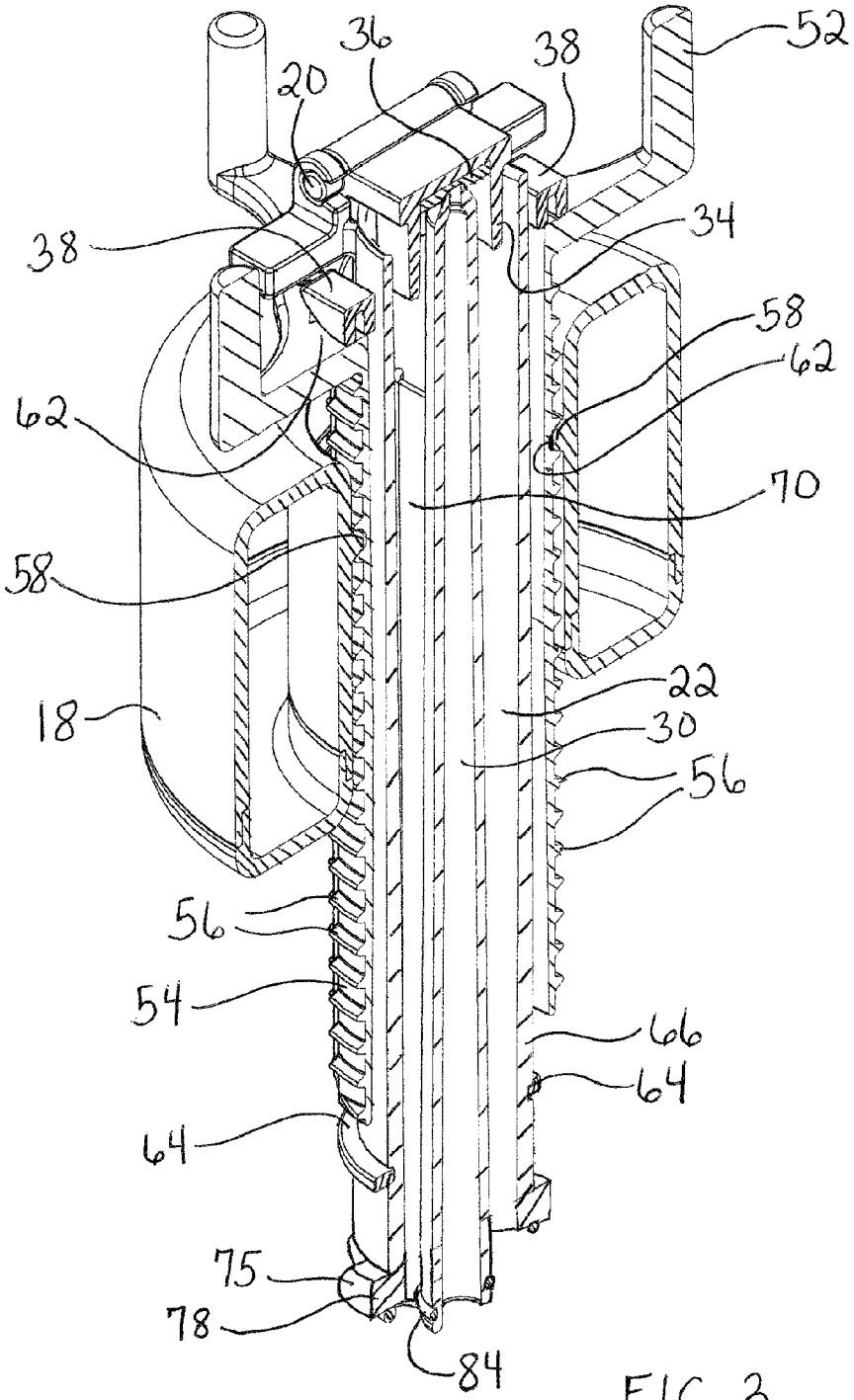
FIG. 3 is a perspective sectional view of an adjustable water leveler core taken along section lines B-B of FIG. 2.

In reference to FIGS. 2 and 3, a particular implementation of float valve assembly 50 comprises a manual adjuster 52 coupled to a rotatable guide 54. The rotatable guide 54 is slidably and rotatably positioned around the outer wall 66 of the valve chamber 22 and comprises a discontinuous external thread 56 in an angled thread pattern. The rotatable guide 54 and water level float 18 each actually float within the housing chamber 10 (FIG. 1) so that the adjuster platform 62 presses the valve actuator 38 closed when the water level float 18 is floating high enough. The water level adjuster 52 is adapted with pins or knobs or other mechanism, such as a grip, for hand adjustment of the water level 16 (FIG. 1) within the housing chamber 10 at which the valve assembly 50 is actuated. A float stop ring 64 coupled to the outer wall 66 of the valve chamber 22 and serves as a limit for the rotatable guide 54 at a point where the water supply valve assembly 50 is fully open. Additionally, with both the rotatable guide 54 and the water level float 18 each floating, the operation of the water leveler system can be tested by hand by pushing down or pulling up on rotatable guide 54, on the water level float 18, on links 42, 44 and 46, or level adjuster 52.

The water level float 18 comprises an internal thread 58 (FIG. 3), similarly angled, on its inner annular surface to match the slope of the external thread 56 on the surfaces of the rotatable guide 54 and cause the water level float 18 to move vertically up and down on the rotatable guide 54 when the manual adjuster 52 is turned. Although the external thread 56 is discontinuous, it comprises one external thread 56. The discontinuous or interrupted external thread 56 may provide any or all of three particular advantages. First, intermittent threads are less likely to become bound by sediment from the water supply and pool. Second, the interruption in the external thread 56 provides a detent to help keep the water level float 18 in place. Third, the rotatable guide 54 passes over the bayonet lugs 78 (FIG. 4) during assembly, but would have excessive play and a loose fit between the rotatable guide 54 and the bottom of the valve assembly 50 without the discontinuous sections through which to pass the lugs. The smaller diameter of the rotatable guide 54 where interrupted may be sized to provide proper clearance. An additional smaller diameter may be provided to engage the snap ring 64 which retains the water level float 18, rotatable guide 54, and valve chamber 22 as an assembly for ease of installation and removal. The water level float 18 can pass over the snap ring for removal while the valve assembly 50 remains intact.

In this particular implementation, though it is not required for all implementations, the external threads 56 are periodically distributed around the rotatable guide 54 (see FIG. 2) and the internal thread 58 on the inner surface of the water level float 18 includes at least one additional raised indicator nub 62 that interferes with the sections of the external thread 56 to provide a tangible "click" each time the indicator nub 62 hits a new section of the external thread 56. The use of the indicator nub 62 also helps to maintain the rotatable guide 54 in its rotationally set position to reduce the likelihood that it will be unintentionally rotated.

By establishing the interrupted thread section spacing at known intervals with a known angle for the threads 56 and 58, the actual water level adjustment being made to the swimming pool water level 14 (FIG. 1) can be accurately made. In conventional swimming pool water level adjustment, there is no precise known way to adjust the swimming pool water level a known height through the water leveler. As a result, when a maintenance worker is attempting to initially set a water level for a swimming pool, the maintenance worker is required to come back several times and through trial and error adjust the water level of the swimming pool to a desired height. In the particular implementation shown in FIGS. 2 and 3, the external threads 56 and internal threads 58 are 4 threads per inch, the maintenance worker can know that a full 360 degree turn of the adjuster 52 will result in a quarter inch adjustment in the swimming pool water level 14. In particular implementations, one or more indications 51 may be included on one of the adjuster 52 handles to visually identify for the user a starting point to simplify counting of the number of full 360 degree turns of the adjuster 52. Cranking in one direction will, of course, result in an increase in the water level and cranking in the other direction will result in a decrease in the water level depending upon the angle of the external thread 56. More complicated cranking systems may equivalently be substituted, but are not necessary and are likely to increase manufacturing cost.

In particular implementations of a water leveler housing where size is of particular concern, to provide for the smallest possible water leveler housing while providing a simplified method of pressure testing, winterizing and ease of valve assembly installation and removal, a sealable valve attachment system is disclosed with specific reference to FIGS. 6-11. It is ordinary to pressure test plumbing connections in the course of pool construction to ensure that plumbing joints are fluid tight. This is of particular importance when the plumbing is covered by concrete as is common in swimming pool construction. In conventional swimming pool construction, the fill water inlet to a water leveler housing is normally threaded and is plugged with a standard threaded pipe plug. These are ordinarily ½ in to ¾ in size and are either on the bottom or the side of the leveler reservoir. Because they are common pipe fittings it is necessary to use ordinary plumbing tool to secure a liquid tight seal. However, this is particularly difficult to do due to the confines of the leveler reservoir. Ordinarily, conventional devices make no provision for pressure testing the balance line or overflow line connection to the leveler reservoir because of the inability to make an easily assembled pressure testing system in the confines of a small leveler housing. Consequently these connections normally go untested.

Figure 7:
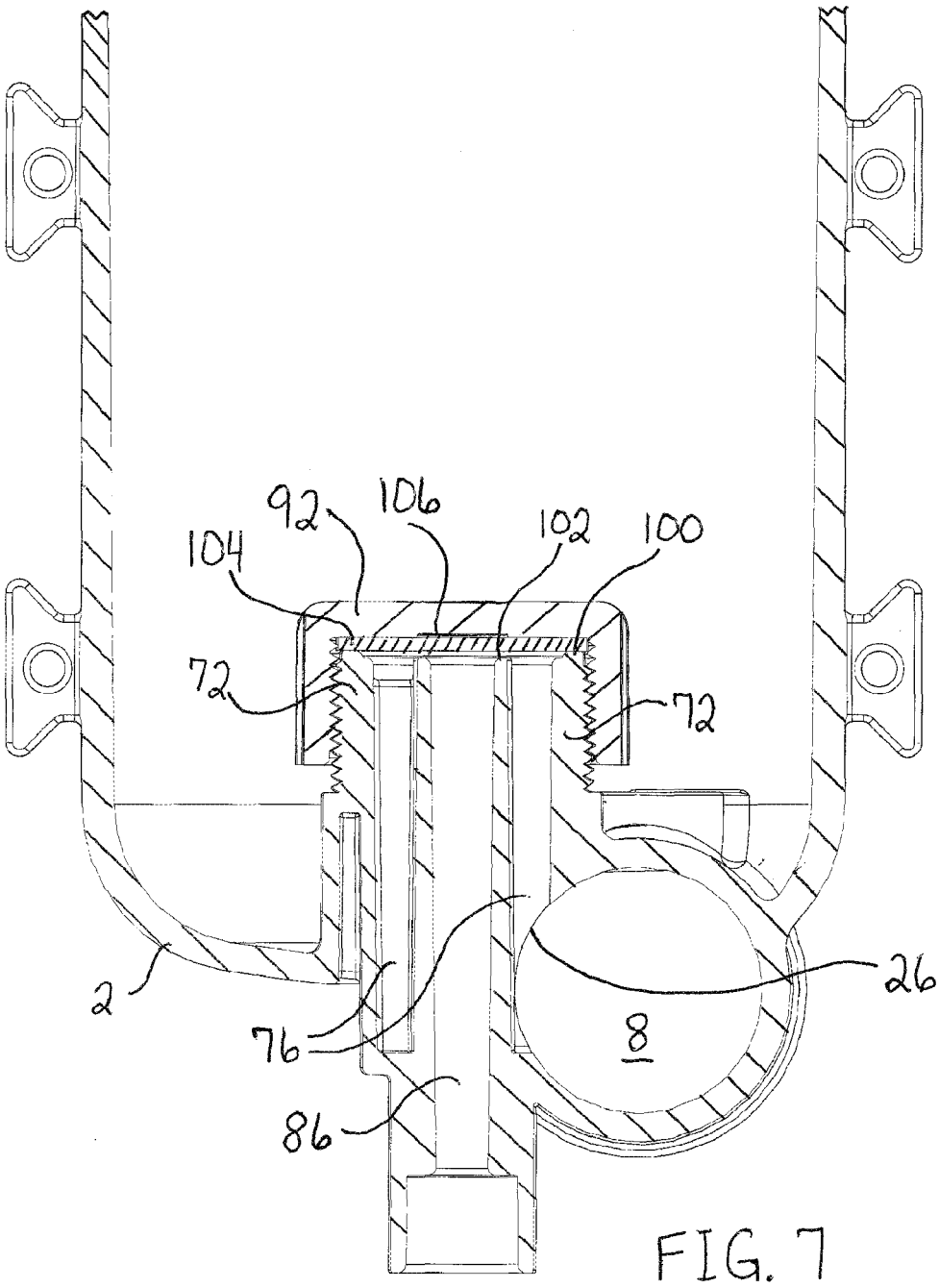
FIG. 7 is a close-up sectional view of the mounting boss taken at a view similar to that of section lines A-A of FIG. 2 if it included the housing with a water source cap coupled to the mounting boss for isolating the water source line for pressure testing.
Figure 8:
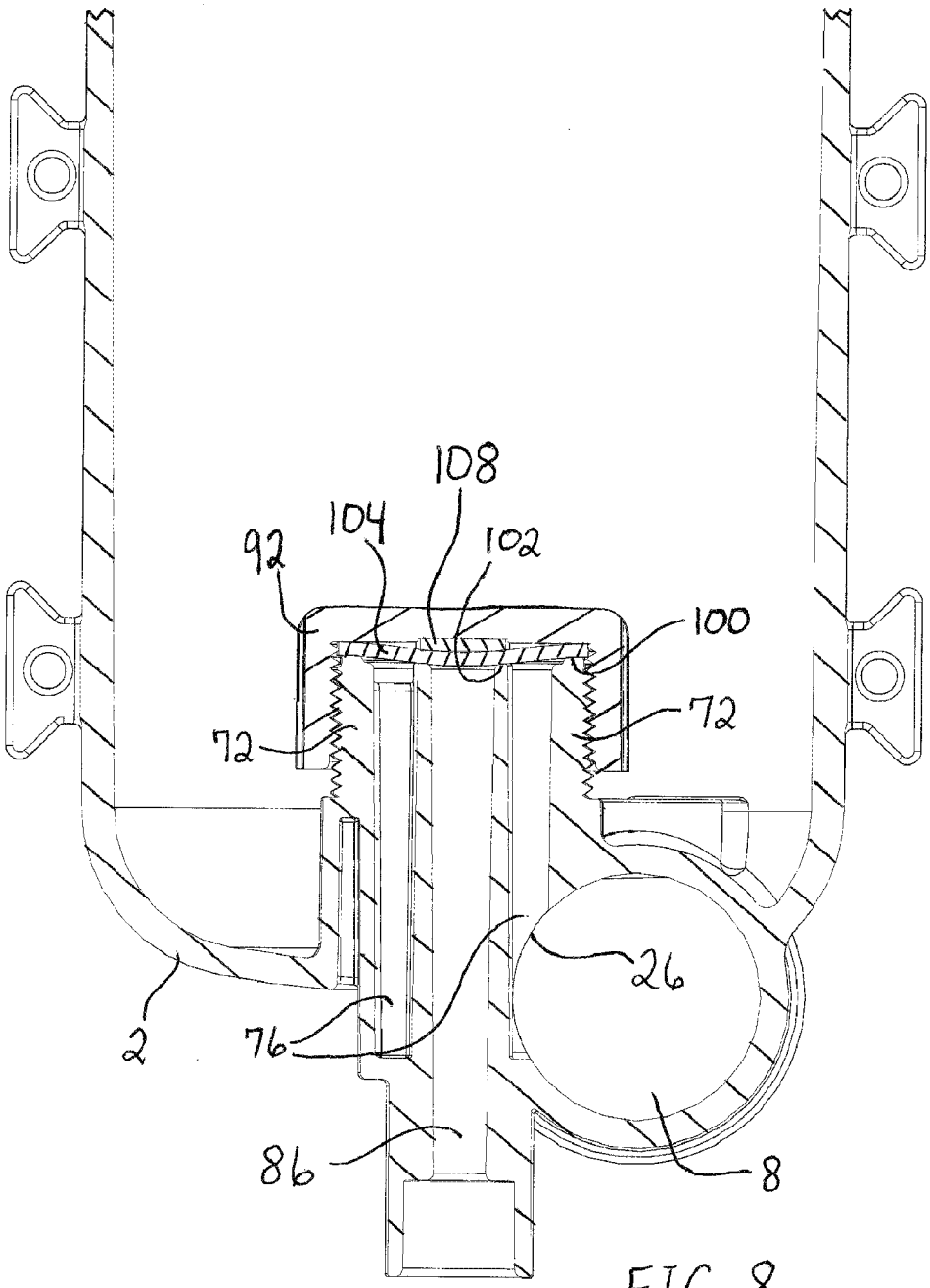
FIG. 8 is a close-up sectional view of the mounting boss and water source cap of FIG. 7 with a seal modifier placed behind the pressure test seal for pressure testing the pressure balance, overflow and pressure lines.

The water leveler housing 2 (FIG. 1) is provided with a mounting boss 72 (FIG. 4). Referring now to FIGS. 7 and 8, the mounting boss 72 is adapted with threads on its outer periphery. The water supply channel 86 is centrally disposed within the mounting boss 72 and is in fluid communication with the water source line (FIG. 1). A channel 76 is formed between the outer surface of water supply channel 86 and the inner surface of mounting boss 72 and is in fluid communication with the passive water line 8 thru the valve chamber opening 26. The mounting boss 72 has an outer seal surface 100 and an inner seal surface 102 on its upper end. A water source cap 92 is adapted with internal threads and a pressure test seal 104 is removably disposed at the closed end of the water source cap 92. The pressure test seal 104 may be made of a suitable soft rubber or plastic material to effect a liquid tight seal between the outer seal surface 100 and the water source cap 92 upon installation of and at least hand tightening of the water source cap 92. It should be noted that the inner seal surface 102 is spaced sufficiently below the pressure test seal 104 to allow liquid flow from the water supply channel 86 to the mounting boss channel 76 and subsequently to the passive water line 8, the balance line 9 and the overflow line 11 (FIG. 1) as previously described. It will be apparent to those familiar with swimming pool plumbing and winterization practices that pressurized water or air introduced into the water source line (FIG. 1) and plugging the balance line 9 entrance and overflow line 11 exit in the conventional manner presents a much simplified and economical method over conventional methods.

In some cases it is desirable to pressure test or winterize only the water source line and attendant water supply channel 8 (FIG. 1). Referring now to FIG. 8, a seal modifier 108 (perspective view of one particular implementation shown in FIG. 11) is installed in a locating recess 106 of the water source cap 92 prior to installation of the pressure test seal 104. The seal modifier 108 is of sufficient thickness to bring the pressure test seal 104 in a sealing relationship with the inner seal surface 102 when the water supply line (FIG. 1) is placed under water pressure. When the water source cap 92 is installed, it can be seen that pressure introduced into water supply 86 is sealed at the inner seal surface 102 and leaves channel 76 unpressurized.

When the balance line 9 and overflow line 11 feed directly into the water leveler housing, pressure testing of the system is done in a piecemeal basis in addition to the difficulties in consistently leveling the pool through water being added to the leveler and waves in the pool feeding back into the leveler through the balance line 9. By placing the seal modifier 108, the water source cap 92 (FIG. 6) and an optional passive water line cap 94 (FIG. 6) on the water leveler housing 2 to block the entrances 12 and 26 (FIG. 1) from the balance line 9 and the overflow line 11 into the water leveler housing 2, the balance line 9 and overflow line 11 can also be pressure tested as one consistent line using the pressure from the water supply line. FIG. 4 illustrates that although the passive water line 8 extends through the water leveler housing 2 at a side of the water leveler housing 2, it is unimpeded by the housing and is a continuous opening of substantially even diameter throughout its passage through the water leveler housing 2. This is in contrast to conventional systems that include a balance line that enters the water leveler housing at a first side of the water leveler housing and a separate overflow line that extends out of the water leveler housing at a different place on the water leveler housing so that the two do not couple with each other.

Mounting the valve assembly is also difficult in conventional systems because introduction of the valve itself further complicates the use of necessary tools to install and tighten the valve within the confines of the leveler reservoir. Because conventional devices are threadably connected to the leveler reservoir. The entire valve assembly must be turned many times in order to install and seal the threadable connection. In some cases there is a conflict between the desired orientation of the valve and the point at which a liquid tight seal is achieved. Because water leveler valves are commonly removed for cleaning, repair and winterization, the advantage of a simplified installation/removal process is apparent.

Figure 9:
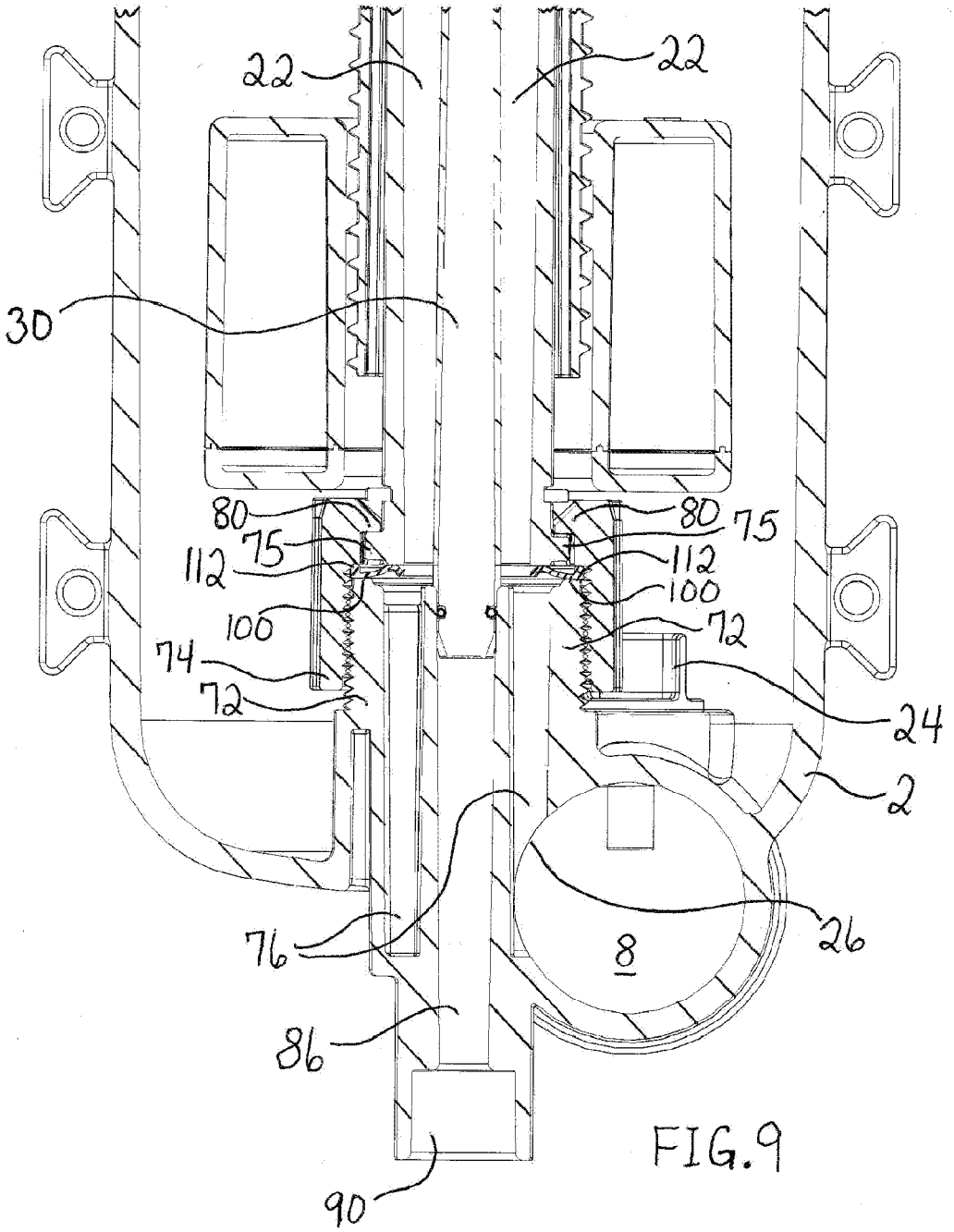
FIG. 9 is a close-up sectional view of the mounting boss coupled to a valve assembly with a spring washer between them.
Figure 11:
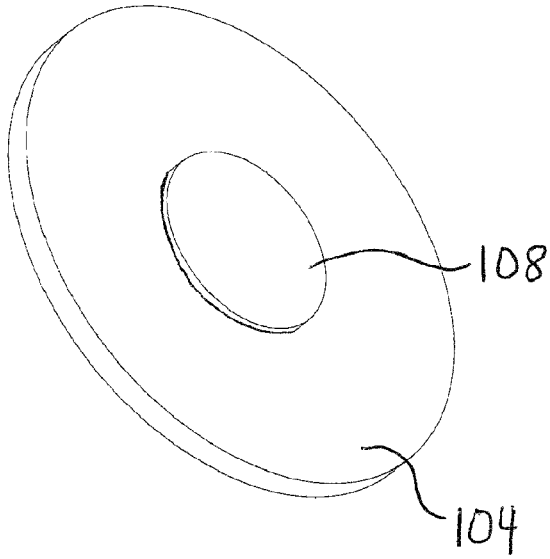
FIG. 11 is a perspective view of a particular implementation of a seal modifier.
Figure 10:
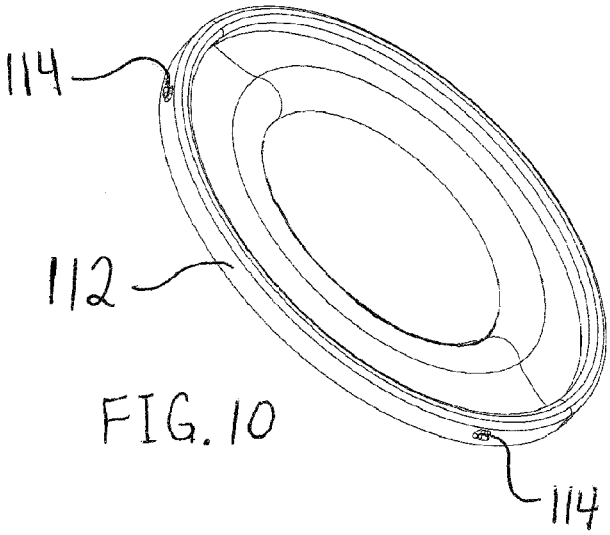
FIG. 10 is a perspective view of a particular implementation of a spring washer.

Referring now to FIG. 9, in order to mount the valve assembly 50 (FIG. 2) to the water level housing 2, the water source cap 92, and associated seals are removed from the mounting boss 72. A retainer cap 74 is adapted with internal threads which mate with the external threads on the mounting boss 72. The retainer cap 74 is further adapted with lugs 80 (FIGS. 2, 4 and 9) to provide a locking relationship with bayonets 75 on the valve assembly 50. A retainer seal ledge 110 extends inwardly from the internal threads of the retainer cap 74. The retainer cap 74 may further be provided with a spring washer 112 (perspective view of one particular implementation is shown in FIG. 10) which is adapted with spring washer detent 114 for a frictional engagement with the internal threads of the retainer cap 74 for retention of the spring washer 112 within the retainer cap 74 at the retainer seal ledge 110. The retainer cap 74 is threadably installed on mounting boss 2 and normally hand tightened to provide a bayonet mount for the valve assembly 50. The spring washer 112 is retained between retainer seal ledge 74 and outer seal surface 100. The inside diameter of the spring washer 112 is generally aligned with the inside diameter of the valve chamber 22 to provide adequate flow between the valve chamber 22 and the channel 76. The upward bias of the spring washer 112 provides a upward force on the lower end of the bayonet lugs 78 to prevent rotation of valve assembly 50 (FIG. 2) by maintaining engagement of lugs 80 with bayonets 75. It will be understood that installation of the valve assembly 50 is achieved by grasping the installation bars 82 (FIG. 2), inserting the valve assembly 50 into the retainer cap 74, manually pushing downward against the bias of the spring washer 112 and rotating valve assembly 50 to engage the lugs 80 with the bayonets 75. Removal is achieved by pushing downward on the valve assembly 50 and rotating in the opposite direction.

An o-ring seal 84 is included around the bottom of the water supply line 30 to maintain a seal between the water supply line 30 and the water supply channel 86 extending through the water leveler housing 2 to the water source plumbing 88. In particular implementations, as indicated by the particular example provided in FIG. 9, a spring washer 112 may also be included to assist in maintaining the seal. The water source plumbing coupling 90 may be configured with a standard outer and inner diameter (for example, half inch pipe size inner diameter and three quarter inch pipe size outer diameter) to couple with common water source plumbing fittings fixtures. At least one channel 76 extends from the valve chamber 22 through the water leveler housing 2 to the valve chamber opening 26 in the passive water line 8.

Conventional water leveler systems either do not deal with overflow water at all (requiring a separate overflow line into the pool), or have the overflow water pass through the water leveler housing from the balance line and into the overflow line which communicates with the interior of the water leveler housing and the over flow piping. The additional water flow through the water leveler housing, however, causes its own problems. If the over flow system is sized large enough to handle heavy rain using 2 in pipe, for example, the balance line entering the leveler reservoir needs to be at least the same size. This contributes to the disadvantage of the pool wave action rapidly changing the level in the leveler reservoir as discuss previously. In commonly used water levelers a ¾ in overflow system is used. These systems do not provide enough overflow capacity in wet climate areas and pool installers are forced to add an additional overflow line, typically 2-in sized, separate from the water leveler at extra cost and effort.

Particular implementations of the present water leveler may be configured to overcome the problem of an entirely separate overflow line without the disadvantage of pool wave action rapidly changing the level in the leveler reservoir. As illustrated best in FIG. 1, the balance line 9 continuously flows through the passive water line 8 into the overflow line 11 so that overflow water, such as from a rain storm or otherwise overflowing pool, does not pass through the water leveler housing 2 to get to the overflow line 11 to escape. Instead, it bypasses the water leveler housing 2, avoids disrupting the water leveler system, yet still disposes of the overflow water without requiring a separate overflow line into the pool structure.

Implementations of swimming pool water levelers, assemblies, and implementing components, may be constructed of a wide variety of materials commonly used for manufacturing swimming pool levelers and plumbing fittings. For example, the components may be formed of: rubbers (synthetic and/or natural) and/or other like materials; glasses (such as fiberglass), carbon-fiber, aramid-fiber, any combination thereof, and/or other like materials; polymers such as thermoplastics (such as ABS, Fluoropolymers, Polyacetal, Polyamide, Polycarbonate, Polyethylene, Polysulfone, and/or the like), thermosets (such as Epoxy, Phenolic Resin, Polyimide, Polyurethane, Silicone, and/or the like), any combination thereof, and/or other like materials; any other suitable material; and/or any combination of the foregoing thereof.

Some components defining swimming pool water leveler implementations may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve vacuum forming, injection molding, blow molding, casting, forging, cold rolling, milling, drilling, reaming, turning, grinding, stamping, pressing, cutting, bending, welding, soldering, hardening, riveting, punching, plating, and/or the like. Components manufactured separately may then be coupled or removably coupled with the other integral components in any manner, such as with adhesive, a weld joint, a solder joint, a fastener (e.g. a bolt and a nut, a screw, a rivet, a pin, and/or the like), washers, retainers, wrapping, wiring, any combination thereof, and/or the like for example, depending on, among other considerations, the particular material forming the components.

In places where the description above refers to particular implementations of swimming pool water levelers, it should be readily apparent that a number of modifications may be made without departing from the spirit thereof and that these implementations may be applied to other swimming pool water levelers. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A method of maintaining a water level in a swimming pool at a predetermined level, the method comprising:
   - passively supplying water from a swimming pool to a sensing chamber of a water leveler housing through a balance line and a first of at least two separate openings between the balance line and the water leveler housing;
   - sensing a water level in the sensing chamber of the water leveler housing corresponding to the water level of the swimming pool; and
   - actively supplying pressurized water from a water supply line to a valve chamber within but separate from the water leveler housing if the water level of the swimming pool is below the predetermined level; and
   - passing water from the valve chamber of the water leveler housing to the balance line and the swimming pool through a second of the at least two separate openings between the balance line and the water leveler housing to raise the water level of the swimming pool to the predetermined level.

2. The method of claim 1, wherein sensing the water level comprises floating a vertically adjustable water level float in the housing chamber coupled to a water supply line spout actuator configured to actuate a water supply line spout if the water level of the swimming pool falls below a predetermined threshold.

3. The method of claim 1, further comprising adjusting a vertical height of a sensor sensing the water level by manually turning an adjuster within the water leveler housing to adjust the predetermined level by a known amount that is known based upon the rotation of the adjuster.

4. The method of claim 3, wherein adjusting the vertical height of the sensor comprises adjusting the vertical height of a water level float coupled to an actuator configured to relieve pressure on a water supply line spout when the water level sensed is below the predetermined level.

5. The method of claim 1, further comprising controlling a flow rate of water from the swimming pool to the sensing chamber with a removable reducer plug removably coupled to the first opening.

6. A method of maintaining water in a swimming pool at a predetermined level, comprising:
   - passively supplying water from a swimming pool to a sensing chamber of a water leveler housing through a balance line and a housing chamber opening between the balance line and the water leveler housing;
   - controlling a flow rate of water from the swimming pool to the sensing chamber with a removable reducer plug removably coupled within the housing chamber opening;
   - sensing a water level in the sensing chamber of the water leveler housing corresponding to the water level of the swimming pool; and
   - actively supplying pressurized water from a water supply line to the balance line if the water level of the swimming pool is below the predetermined level.

7. The method of claim 6, wherein actively supplying pressurized water from the water supply line to the balance line comprises:
   - actively supplying pressurized water from the water supply line to a valve chamber within the water leveler housing but separate from the housing chamber when the water level of the swimming pool is below the predetermined level; and
   - passing water from the valve chamber to the balance line and the swimming pool through a valve chamber opening between the housing chamber and the balance line to raise the water level of the swimming pool to the predetermined level.

8. The method of claim 7, wherein sensing the water level comprises:
   - floating a vertically adjustable water level float in the housing chamber responsive to the water level in the swimming pool; and
   - actuating transfer of water from the water supply line to the valve chamber when the water level of the swimming pool falls below a predetermined threshold and lowers the adjustable water level float.

9. The method of claim 8, wherein actuating transfer from the water supply line to the valve chamber comprises opening a water supply valve between the water supply line and the valve chamber.

10. The method of claim 9, wherein opening the water supply valve between the water supply line and the valve chamber comprises at least partially lifting a cap covering the water supply line valve with a water supply line spout actuator coupled to the vertically adjustable water level float.

11. The method of claim 10, further comprising adjusting a vertical height of the water level float to adjust the predetermined level.

12. The method of claim 11, wherein adjusting the vertical height of the water level float comprises manually turning a linearly adjustable annular ring with at least one inwardly extending thread about a rotatable guide comprising at least one external thread to adjust the predetermined level.

13. A method of maintaining water in a swimming pool at a predetermined level, comprising:

passively supplying water from a swimming pool to a sensing chamber of a water leveler housing through a balance line extending from the swimming pool to the water leveler housing and a housing chamber opening between the balance line and the water leveler housing;

sensing a water level in the sensing chamber of the water leveler housing corresponding to the water level of the swimming pool; and actively supplying pressurized water from a water supply line at the water leveler housing back through the balance line to the swimming pool if the water level of the swimming pool is below the predetermined level without the pressurized water from the water supply line entering the water in the sensing chamber before entering the water in the balance line.

14. The method of claim 13, wherein actively supplying pressurized water from the water supply line to the balance line comprises:

actively supplying pressurized water from the water supply line to a valve chamber within the water leveler housing but separate from the housing chamber when the water level of the swimming pool is below the predetermined level; and directly passing water from the valve chamber to the balance line through a valve chamber opening between the housing chamber and the balance line to raise the water level of the swimming pool to the predetermined level.

15. The method of claim 14, wherein sensing the water level comprises:

floating a vertically adjustable water level float in the housing chamber responsive to the water level in the swimming pool; and actuating transfer of water from the water supply line to the valve chamber when the water level of the swimming pool falls below a predetermined threshold and lowers the adjustable water level float.

16. The method of claim 15, wherein actuating transfer from the water supply line to the valve chamber comprises opening a water supply valve between the water supply line and the valve chamber.

17. The method of claim 16, wherein opening the water supply valve between the water supply line and the valve chamber comprises at least partially lifting a cap covering the water supply line valve with a water supply line spout actuator coupled to the vertically adjustable water level float.

18. The method of claim 17, further comprising adjusting a vertical height of the water level float to adjust the predetermined level.

19. The method of claim 18, wherein adjusting the vertical height of the water level float comprises manually turning a linearly adjustable annular ring with at least one inwardly extending thread about a rotatable guide comprising at least one external thread to adjust the predetermined level.

* * * * *